US007891116B1

(12) United States Patent
Iglikov

(10) Patent No.: US 7,891,116 B1
(45) Date of Patent: Feb. 22, 2011

(54) FOOTWEAR AND ITS MANUFACTURE

(76) Inventor: Nikolay Iglikov, 240 Portage Rd., Lewiston, NY (US) 14092

( * ) Notice: Subject to any disclaimer, the term of this patent is extended or adjusted under 35 U.S.C. 154(b) by 769 days.

(21) Appl. No.: 11/903,371

(22) Filed: Sep. 21, 2007

Related U.S. Application Data

(60) Provisional application No. 60/846,522, filed on Sep. 21, 2006.

(51) Int. Cl.
*A43B 1/10* (2006.01)

(52) U.S. Cl. ..... 36/4; 36/9 R; 36/45

(58) Field of Classification Search ..... 36/4, 36/9 R, 45, 3 R, 55, 10
See application file for complete search history.

(56) References Cited

U.S. PATENT DOCUMENTS

| | | | | |
|---|---|---|---|---|
| 2,686,376 | A * | 8/1954 | Burkholz | 36/9 R |
| 4,294,022 | A * | 10/1981 | Stockli et al. | 36/4 |
| 4,599,810 | A | 7/1986 | Sacre | |
| 5,913,592 | A * | 6/1999 | Moore | 36/8.1 |
| 6,065,227 | A * | 5/2000 | Chen | 36/4 |
| 6,467,116 | B1 * | 10/2002 | Strickland | 12/142 D |
| 6,474,002 | B2 * | 11/2002 | Chen | 36/55 |
| 6,665,954 | B2 * | 12/2003 | Chen | 36/3 R |
| 2007/0039210 | A1 * | 2/2007 | Clark et al. | 36/113 |
| 2007/0204482 | A1 * | 9/2007 | Gibson-Collinson | 36/10 |
| 2008/0216354 | A1 * | 9/2008 | Morlacchi et al. | 36/98 |

* cited by examiner

*Primary Examiner*—Ted Kavanaugh
(74) *Attorney, Agent, or Firm*—Kloss, Stenger & LoTempio; Vincent G. LoTempio

(57) ABSTRACT

A rubberless neoprene boot waterproofed from the inside comprised of a composite sock fabricated from a neoprene foam, coated with a polyurethane film sandwiched by an inner boot liner and a stretchable external layer that may be stretched and formed upon a shoe last. A composite upper shaft section made of neoprene foam, polyurethane film and an inner boot liner, and a semi-stretchable external durable fabric extending from said sock. An external foot jacket jacketing the sock forming an upper boot unit having internal seams with a series of thermoplastic heat sealing tapes to collectively seal all said internal seams against the penetration of moisture and a toe reinforcing stiffener and a heel reinforcing stiffener located between the stretchable external layer of said sock and the foot jacket. An inner sole secured to the sock and an outer sole securely anchored to a bottom end of the inner sole.

7 Claims, 9 Drawing Sheets

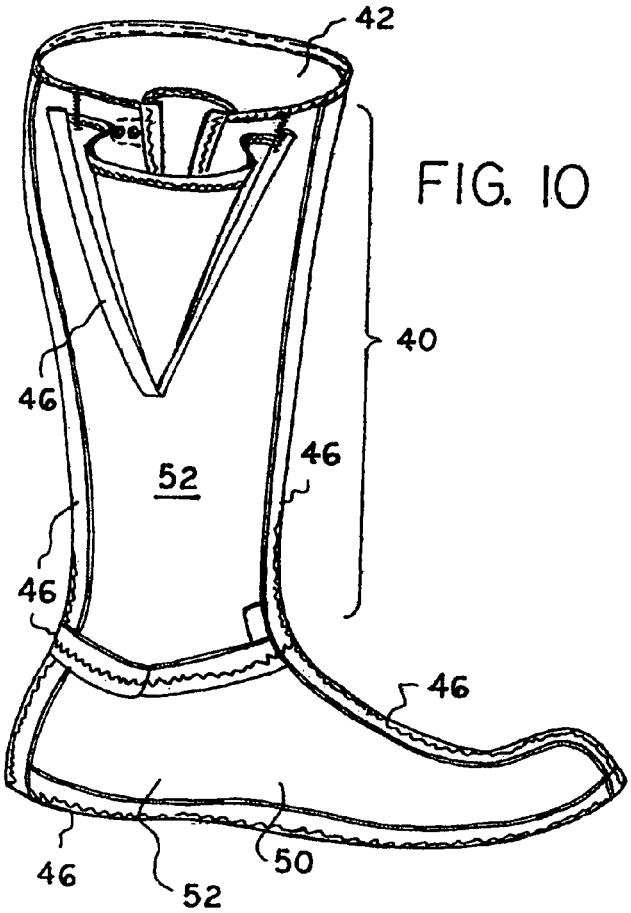
FIG. 10
FIG. 11
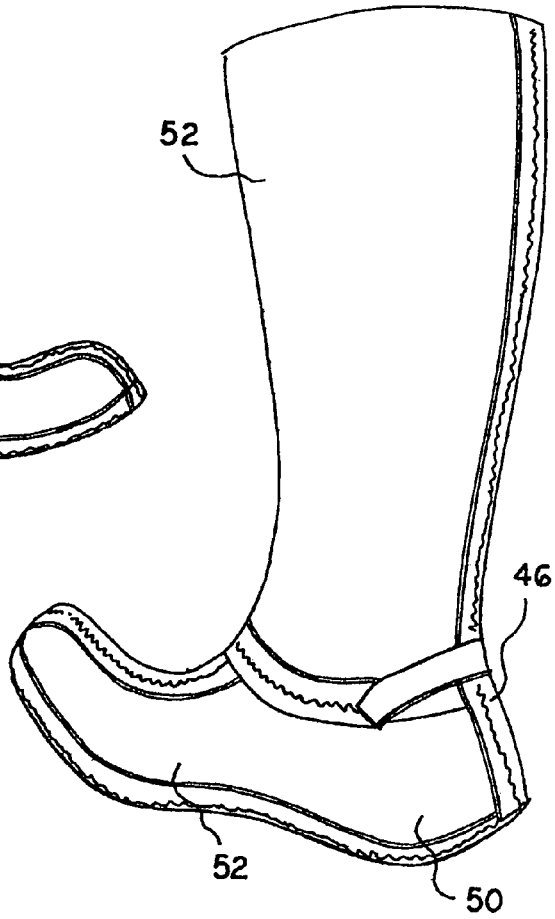
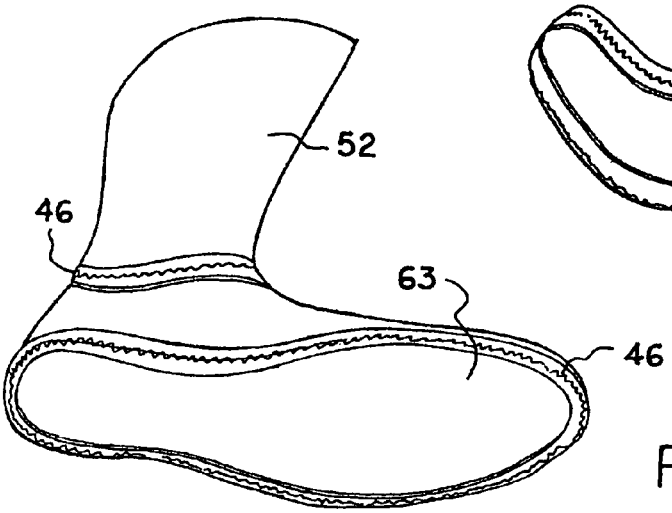
FIG. 12

FIG. 13
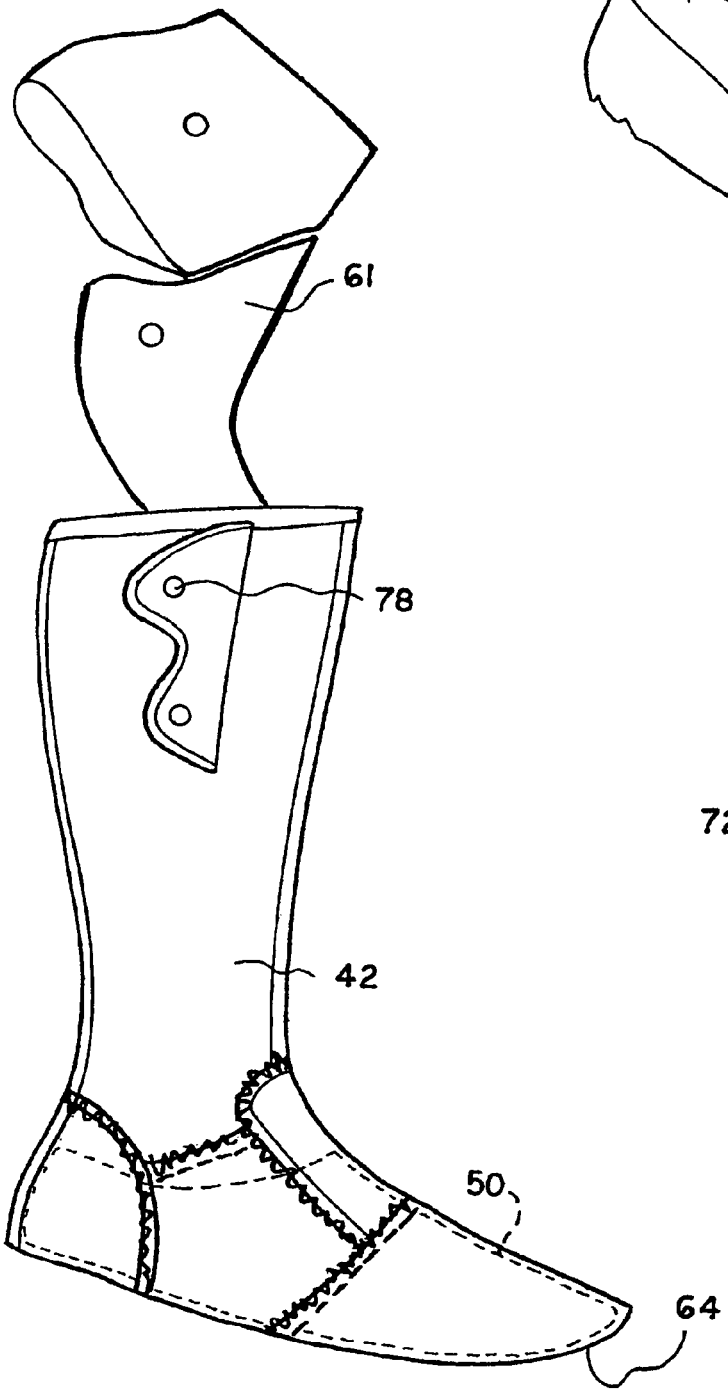
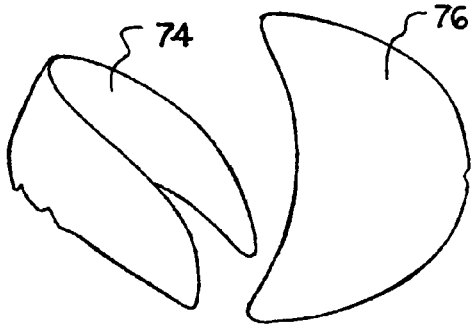
FIG. 14
FIG. 15
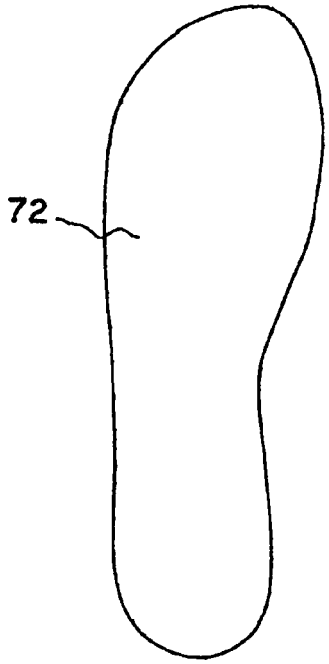

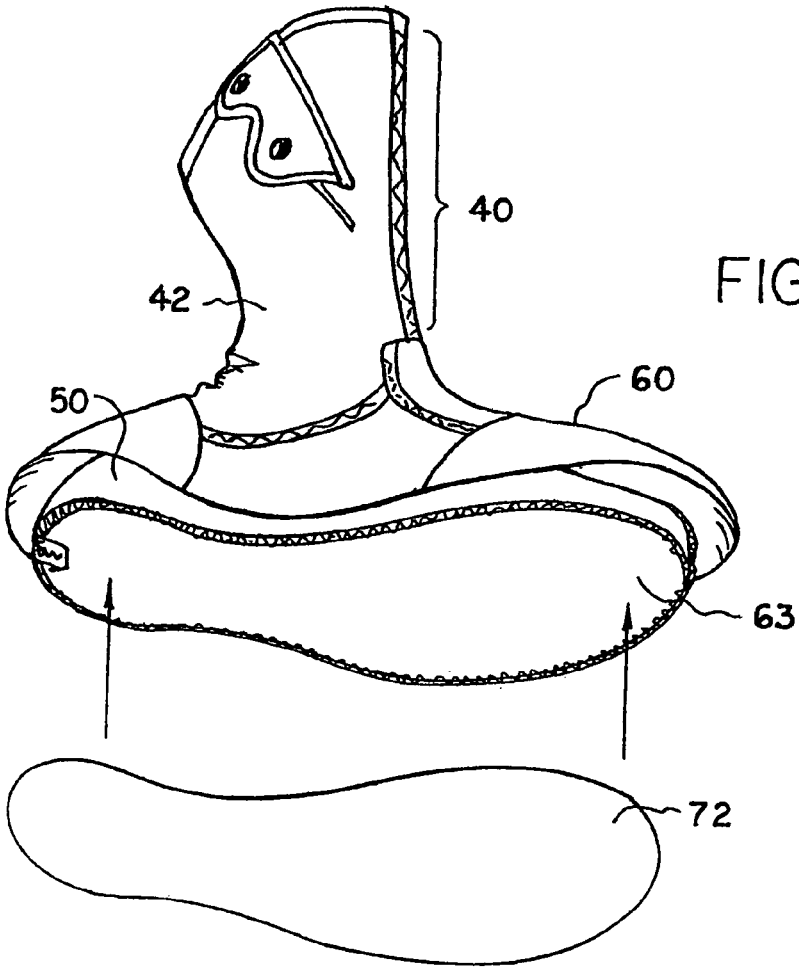
FIG. 16
FIG. 17
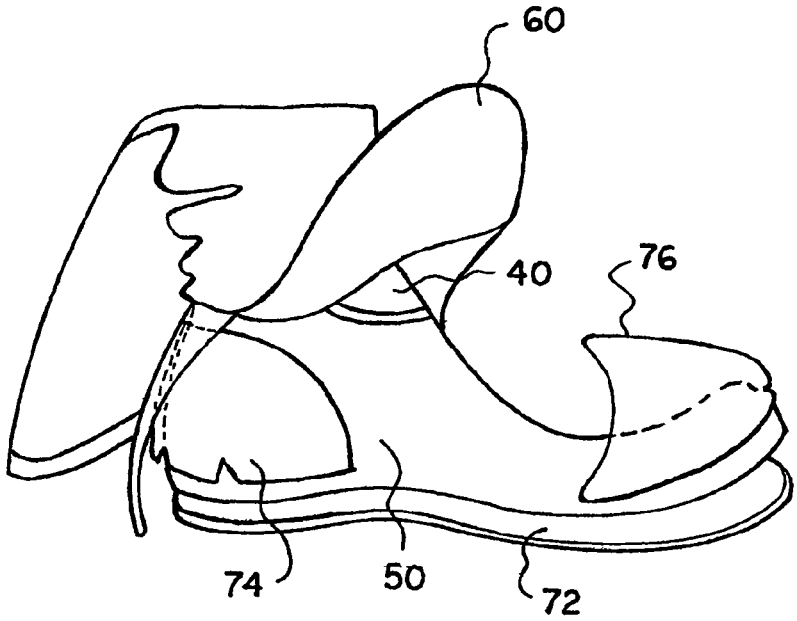

FOOTWEAR AND ITS MANUFACTURE

This application claims priority of U.S. Provisional Patent Application to Nikolay Iglikov Ser. No. 60/846,522 for FOOTWEAR AND ITS MANUFACTURE, filed on Sep. 21, 2006.

BACKGROUND OF THE INVENTION

1. Field of Invention

The present invention relates to footwear and, more particularly, to unique neoprene footwear products and their manufacture.

2. Background of the Invention

The manufacture of rubber footwear products for use by the general public and most typical outdoors person such as hunters and fisherman has made relatively small inroads in meeting modern day needs. When it is desired to create an insulated and waterproof footwear product, the mainstay typically entails a bulky and heavy rubber vulcanized fit for use only by the young and hardy. The endeavors to create a lightweight, waterproof and insulated footwear product generally has led to replacing the heavy rubber components and the less durable thermoplastic substitutes such as currently used in PVC jacketed footwear products. Also, footwear products typically adapted for use under wet, inclement conditions are notoriously known for their improper fitting and especially about the ankles and foot, consequently the limb tends to move independently and float within the footwear gear when used. A typical rubber boot is made of non-stretchable rubber and the ankle area of the boot has to be made wide enough to allow the users foot entry in the boot. As a result a rubber boot has to be manufactured so that it does not fit snugly around the ankle.

Several articles of manufacture have been invented to facilitate a light weight, breathable and durable footwear product, for example U.S. Pat. No. 4,599,810 issued to Sacre, discloses an inner liner for a shoe that makes the shoe waterproof and at the same time allows the foot to breathe. To accomplish this purpose, the liner is constructed of a material that is impervious to water but is pervious to perspiration vapors. But this waterproof and breathable shoe liner does not possess the necessary contour fitting so as to move in a substantial harmony with the ankle, foot, and calf of the wearer. The problem with this design is that the liner is independent from the exterior substance of the rubber boot and is dependent upon the stretchability and fitability of the exterior component.

Another example is U.S. Pat. No. 6,665,954 issued to Chen, which discloses a boot which includes a shell having a foot portion and an upper. The shell is composed of a waterproof first part and at least one non-waterproof air-pervious second part. This patent for footwear generally addresses only one of the desired attributes, namely, having a boot that is waterproof and breathable but does not address the problem associated with float, improper fit and the foot protection.

Other types of shoes have been provided that are completely waterproof, such as rubber or plastic shoes, but here again the feet cannot breathe and such shoes are generally uncomfortable and unhealthy in their use. Also, this latter type of shoe is not fitted to the user's body.

Thus it is readily apparent that there is a long felt need for a durable lightweight, insulated and waterproof footwear product capable of mass production at a relatively inexpensive cost. A footwear product which would preserve the durability and protective structural integrity of current top quality rubber footwear products, while also providing the desired lightweightness, waterproof and insulated attributes would fulfill a long existing need. There also exists a need for a durable, lightweight and waterproof footwear product which possesses the necessary contour fitting so as to move in a substantial harmony with the ankle, foot, and calf of the wearer so as to thereby provide a more effortless, comfortable and safer footwear product. The present invention meets these long-felt needs. It is with an extension of the foregoing knowledge that the present invention is concerned.

SUMMARY OF THE INVENTION

It is accordingly a primary object of the present invention to provide a foot wear product which provides an appropriate substrate for insulating, lightness, structural integrity, durability, fitting, comfort and sealability.

Another object of the invention is to provide a durable lightweight, waterproof and insulated and protective footwear product made of a composite laminar construction.

Yet another object of the invention is to provide a waterproof footwear product made of a composite material having an exterior comprising of durable stretchable fabric, an interior comprising an insulating foam core, at least one heat reflecting polyurethane layer and an inner layer fabric capable of waterproof taping.

Another further object of the invention is to provide a product made of a composite material having an interior comprising an insulating foam core, at least one heat reflecting polyurethane layer and a tapable waterproofable internal fabric layer.

Another object of the invention is to provide an integrated construction of the footwear product that retains its structural integrity and durability while protectively shoeing the wearer's feet.

A further object of the invention is to provide a waterproof footwear product having rubberless upper boot unit that is durable, lightweight which possesses the necessary contour fitting so as to move in a substantial harmony with the ankle, foot, and calf of the wearer so as to thereby provide a more effortless, comfortable and safer footwear product.

Yet another object of the invention is to provide a high quality footwear product at an affordable cost.

Additional objects and advantages will become apparent and a more thorough and comprehensive understanding may be had from the following description and claims taken in conjunction with the accompanying drawings forming a part of this specification.

The footwear product allows the young and old, the freedom and dexterity to readily move about with the minimum of foot effort and comfort even under the most trying or strenuous conditions. The footwear products of this invention may be constructed of a waterproof and insulated upper composite (an upper shaft section) fabricated from an insulated, laminated composite pieces secured together chambering onto composite sock collectively sealed against the penetration of moisture and an external foot jacket jacketing (on an external upper jacketing the sock) the sock and bordering onto an inner sole and a sole securely anchored onto a bottom end of the footwear product. The foot sock and the footwear upper may be appropriately made of a composite laminar construction which provides an appropriate substrate for insulating, lightness, structural integrity, durability, fitting, comfort and sealability as required by a quality outdoor footwear product. The upper shaft, sock and external foot jacket may be appropriately sewn together and then internally sealed with a sealing tape which seals the seams, the sealed seamed perforations and adjoining capillary margins prevent external water from seeping or wicking into the footwear product. After seaming and sealing together the upper shaft, sock and jacketing foot jacket, the sock may be stretched or formed to the appropriate foot size upon a shoe last whereupon the toe and heel reenforcing stiffeners may be inserted and the insole and out sole attached thereto to provide the finished footwear product. By reason of the manner in which the footwear product is constructed and the particular composite components used in its manufacture, a firm but flexible, durable, lightweight, superior fitting, comfortable, waterproof, and insulated footwear product possessing uniquely different footwear attributes may be thereby obtained.

BRIEF DESCRIPTION OF THE DRAWINGS

The present invention and the manner in which it may be practiced is further illustrated with reference to the accompanying drawings wherein:

FIG. 10 is a side view of the footwear product shown in FIG. 8 turned inside out wherein all sewn seams are waterproofed by sealing tape.

FIG. 11 is an elevational rear view of the footwear product shown in FIG. 8 turned inside out wherein all sewn seams are waterproofed by sealing tape.

FIG. 12 is a bottom view of the footwear product shown in FIG. 8 turned inside out wherein all sewn seams are waterproofed by sealing tape.

FIG. 13 is an elevational side view of an unhinged last being inserted into a partially assembled footwear product after it is waterproofed.

FIG. 14 shows a heel counter and toe box stiffener used in fabricating the footwear product.

FIG. 15 is a view of an insole used in making the footwear product.

FIG. 16 is an elevational view of a partially completed footwear product with a shoe last inserted and an unattached sole being attached to the bottom of the sock.

FIG. 17 depicts the insertion of the toe box and heal counter between the footwear sock and the foot jacket as employed in the fabrication of the footwear product.

DETAILED DESCRIPTION OF THE INVENTION

Figure 1:
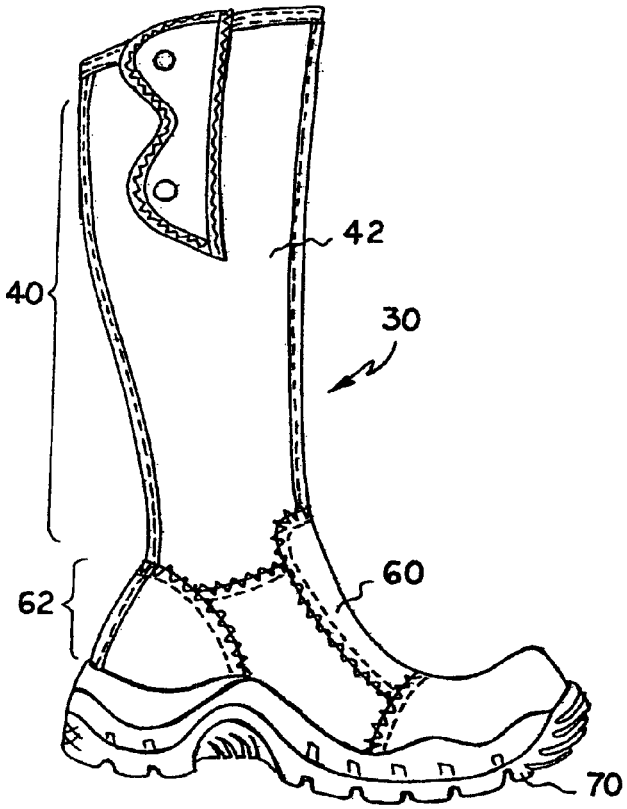
FIG. 1 is a front perspective view of a footwear product device of the present invention.

This application claims priority of U.S. Provisional Patent Application to Nikolay Iglikov Ser. No. 60/846,522 for FOOTWEAR AND ITS MANUFACTURE, filed on Sep. 21, 2006.

At the outset, it should be clearly understood that like reference numerals are intended to identify the same structural elements, portions, or surfaces consistently through out the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Adverting now to the drawings, with reference to FIG. 1, a preferred embodiment of the present invention is indicated as footwear product 30. The footwear product 30 possesses a host of desirable attributes which uniquely distinguish it from existing footwear products and enhances its efficacy by the footwear user when used under the most inclement conditions. Footwear product 30 comprises a laminated composite upper shaft 40 internally communicating onto a laminated composite sock 50 (shown in FIGS. 4 and 5) of a predetermined foot size protectively enshrouded by foot jacket 60 and an outsole securely attached to provide a footwear product 30 illustratively depicted in FIGS. 1-3. The footwear product 30 as depicted is commonly referred to as a high top boot which includes a foot section 62 and upper shaft 40.

The construction and design of the footwear product 30 of this invention provides a footwear product which cooperatively functions in conjunction with the boot and allow movement of both the limb and the footwear product 30 as a unitary and contour fitting unit. The sock 50 of the footwear product 30 serves to superficially engage the foot above the ankle and throughout the foot section so that the footwear product 30 feels and wears upon the wearer's foot more as a sock than a boot or shoe. Thus, the footwear product 30 moves in unison (rather than independently) with the wearer's ankle and foot, thus avoiding footwear creep. Similarly, the upper shaft section 40 construction mates onto the muscular movement of the calf muscle to enhance fit, use and comfort. A broad spectrum of footwear products ranging ankle top, high top, laced and unlaced boots, military, cowboy footwear, fashion; hip waders, slippers and other footwear sized to fit about the foot and particularly above the wearer's ankle may be manufactured by this technology.

The FIGS. 4-18 depict footwear product 30 and the sequential steps of manufacturing the footwear product 30 from patterned pieces involving unique composite patterned pieces sewn and internally sealed together with other footwear components by unique processing and footwear techniques.

Figure 4:
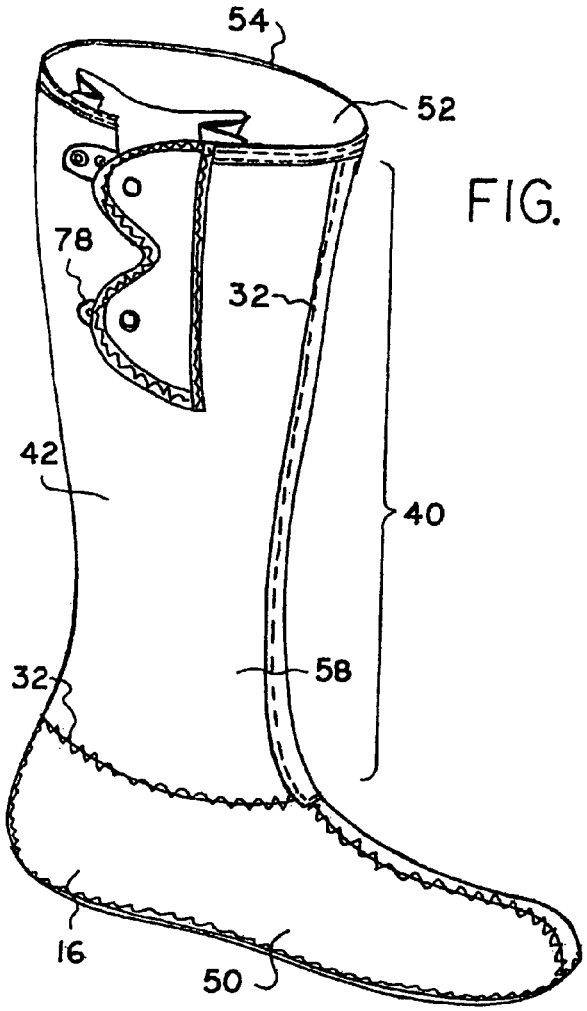
FIG. 4 is a side view of the sock and the upper shaft portion of the footwear product of the present invention sewn together.
Figure 5:
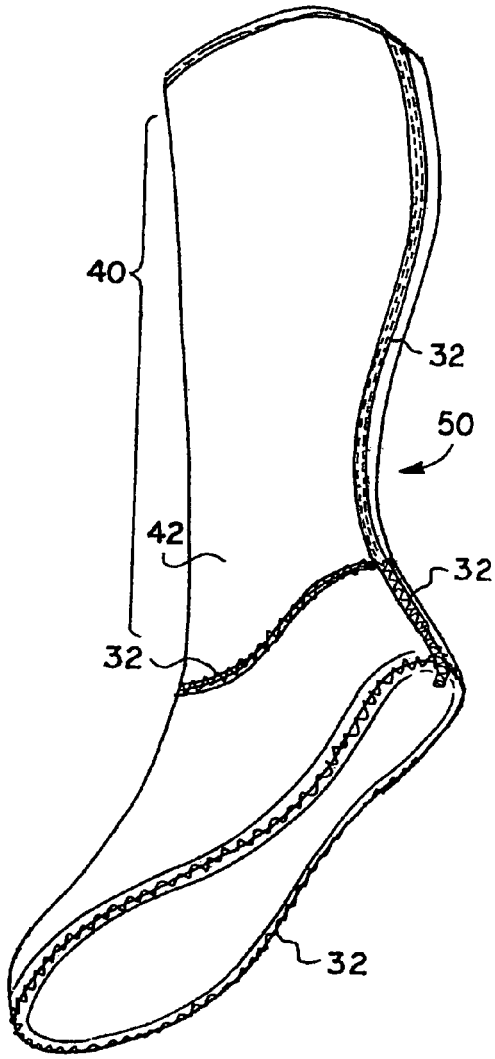
FIG. 5 is a side bottom view of the sock and the upper shaft portion of the footwear product of the present invention sewn together.

As illustrated in FIGS. 4 and 5 the footwear product 30 includes an internally disposed sock 50 and the upper shaft 40 which elastically and comfortably circumscribes the ankle and foot of the wearer. In essence both the upper shaft 40 and the sock 50 include basic materials which allow for the waterproofing of the sewn seams 32 as well as providing a more appropriately leg calf, ankle and foot fitting footwear product 30. Upper shaft 40 and preformed sock 50 in combination with a heat sealing tape allow the sewn seams 32 and juxtapositioned seamed margins to be sealed against wicking or seepage of water through the seamed area.

The upper portion in the ankle area of the sock 50 and the upper shaft 40 desirably possess girth stretchability which allows the component parts to elastically and comfortably conform to the contour of the wearer's ankle and thereby maintain the fit about the wearer's ankle. The upper portion in the ankle area of the sock 50 and the upper shaft 40 in effect walks with the ankle, lower calf and foot of the wearer. The type of movement that is commonly found in ordinary rubber boots such as float or upwardly or downwardly movement of the footwear as well as forward, backward or sideward slide of the foot within ordinary footwear is essentially eliminated by the unique construction of the footwear product 30. The composite upper shaft 40 (refers to the laminated upper shaft section of footwear product 30) also provides an ability to retain its structural upper shaft identity with sufficient girth stretch so as to conform the upper shaft 40 to the wearer's leg calf and maintain the appropriate position for comfortable use by the wearer.

Figure 20:
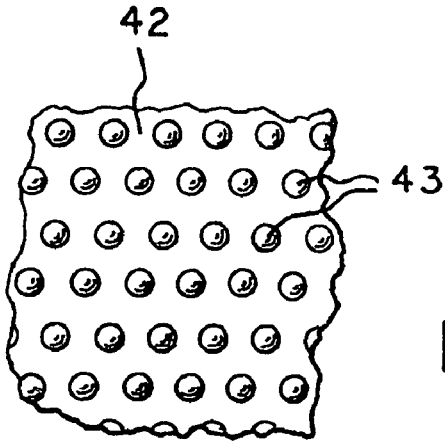
FIG. 20 is a close-up top view of one embodiment of the external surface of the footwear product of the present invention.

The upper shaft 40 (as depicted in FIGS. 4 and 5) and sock 50 may be appropriately fabricated from a foam core 54 coated or laminated on at least one side (advantageously upon the inner or internal side) with PU film 53 (a heat reflecting metal alloy coating such as by a titanium alloy or a polyurethane film coating) and sandwiched by an internal tricot fabric layer 52 and an external layer 42 (the details of which is shown in FIG. 20).

A wide range of materials may be used for the fabric based exterior (e.g. the exterior of footwear upper shaft 40 and sock 50). Particularly useful are those fabrics possessing the necessary characteristics of strength, lightweight, water penetration resistance and durability to serve effectively as a footwear exterior shell. Polyesters and nylon are illustrative materials that may be used to fabricate the exterior. The stretch characteristics of the fabric of the external layer is altered by the type of material and type of knit utilized to make the sock and the upper shaft of footwear product 30. For example, if it is desired to achieve a durable exterior surface there will be less stretch in the material, i.e. the exterior material for the upper shaft. For another example, exterior fabric 42 of sock 50 is made of a material that should possess greater amount of stretch so as to allow it to conform to the footwear forming last as depicted by FIG. 13. Durability is not a characteristic that is important for the exterior of the sock composite. Sock 50 is made of synthetic woven and knitted fabric having greater stretchable characteristics, for example.

Figure 6:
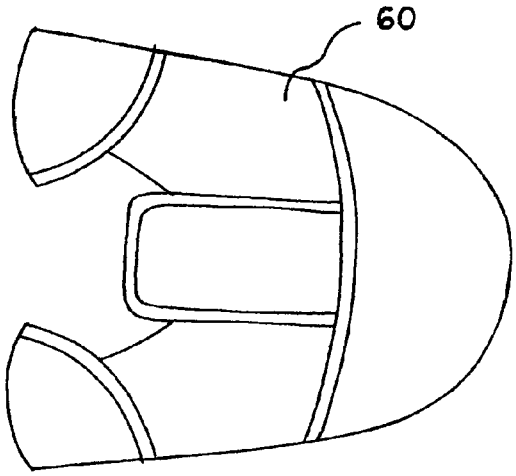
FIG. 6 is a top view of a foot jacket used in the fabrication of the footwear product.

FIG. 6 depicts a top view of foot jacket 60 used in the fabrication of the footwear product. In a preferred embodiment of the present invention, foot jacket 60 is comprised of a single layer of material suitable for the exterior of a boot, an oxford polyester for example. It is desirable in the manufacture of foot jacket 60, to provide an exterior layer of foot section 62 with greater durability and protection for the foot of the user. Another function of foot jacket 60 is to prepare for attachment of the outer sole and to a cover the toe box, the heal counter and the insole. The jacket should be a durable non-stretchable material that holds its integrity after the lasting process.

Figure 7:
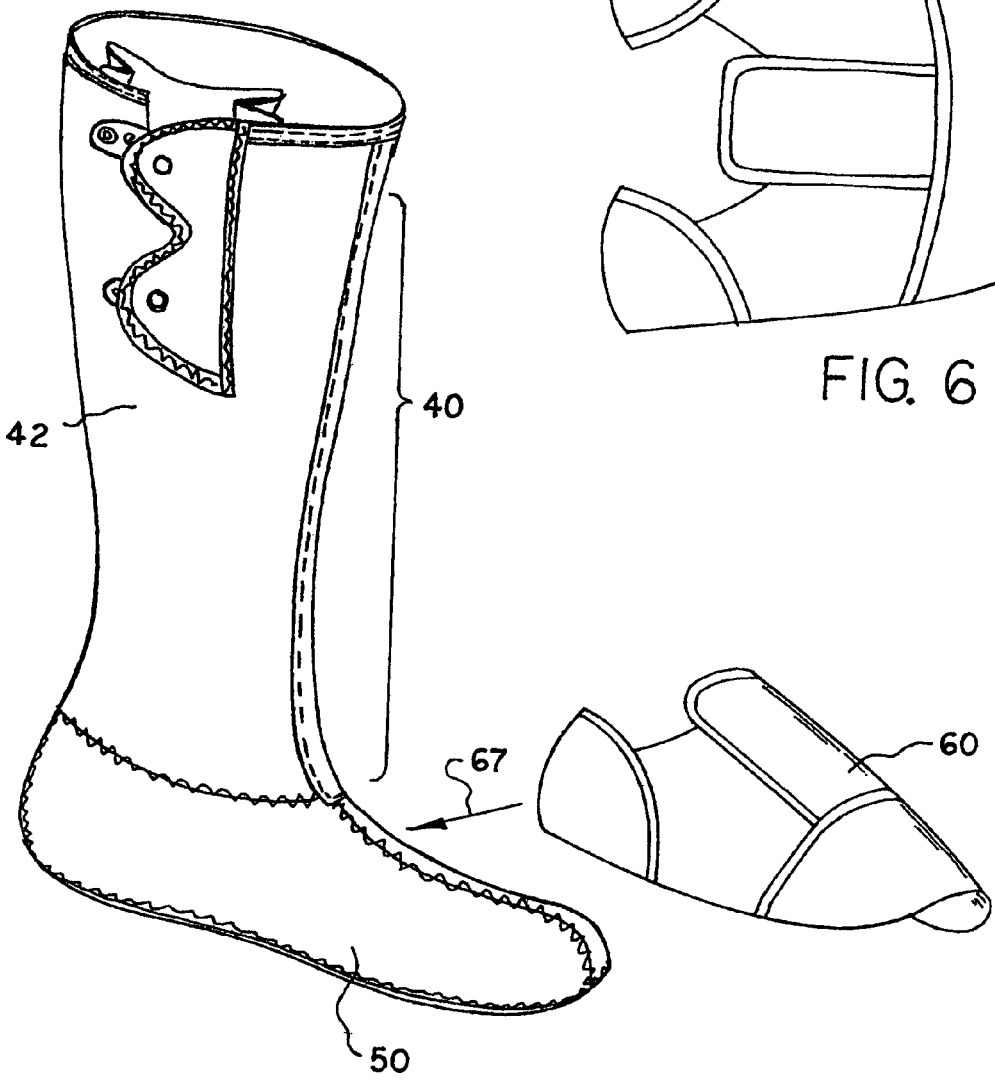
FIG. 7 is a partial exploded view of the present invention, showing how the foot jacket mates with the sock.
Figure 9:
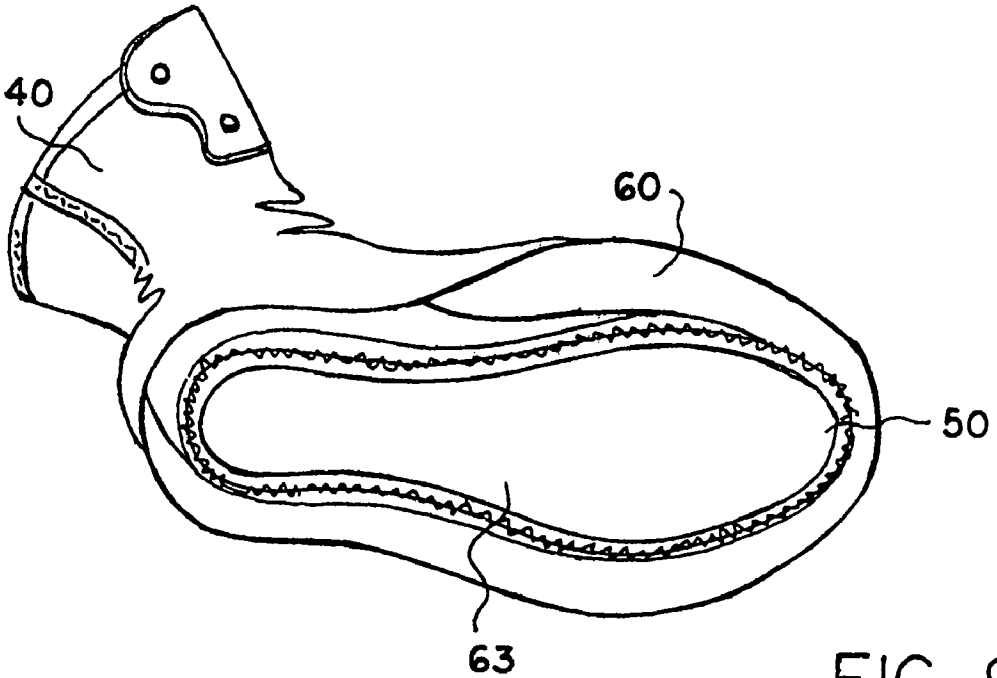
FIG. 9 is an elevational bottom view showing the inner construction of a partially completed footwear product.
Figure 8:
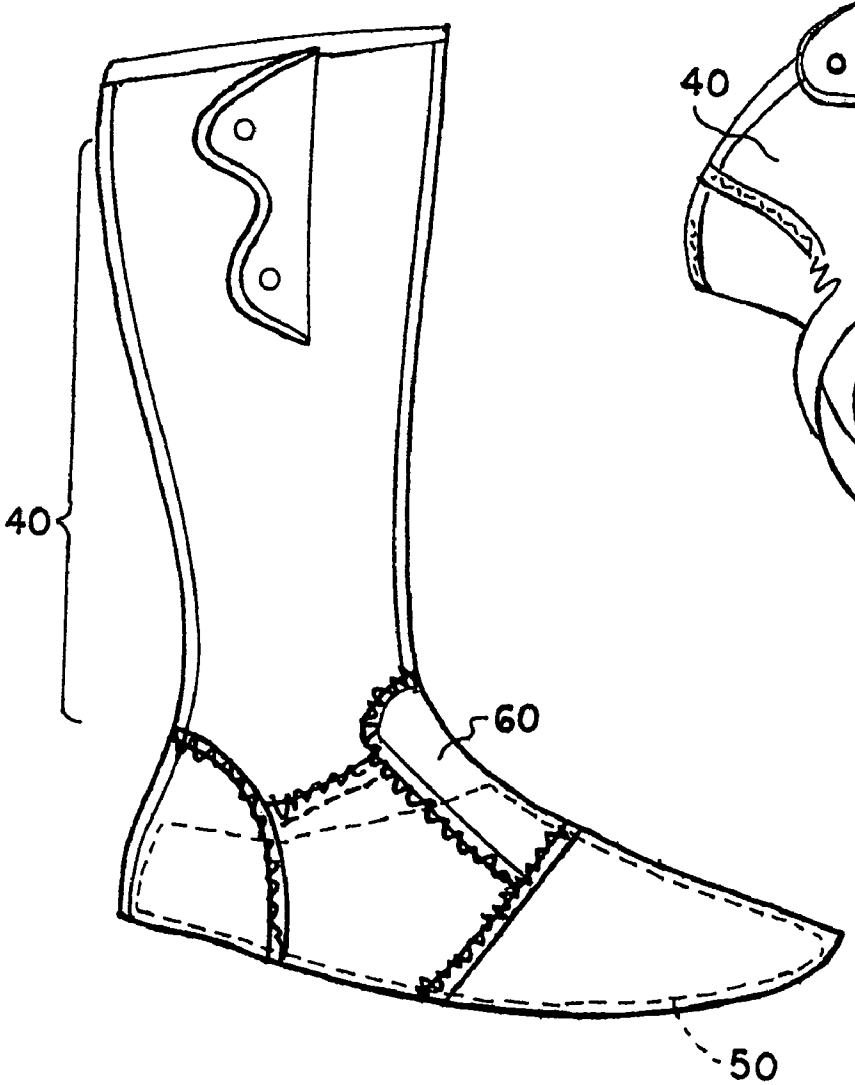
FIG. 8 is an elevational side view showing a foot jacket, sock and upper shaft sewn together.

FIG. 7 is a partial exploded view of the present invention, showing how the foot jacket mates with the sock in the general direction of the arrow 67. FIG. 8 is an elevational side view showing a foot jacket, sock and upper shaft sewn together. Foot sock 50 is fitted with a foot jacket 60 before sock 50 is placed upon a forming last so as to conform sock 50 to the contour of the user's foot. The composite upper shaft 40 section, foot jacket 60 and sock 50 are respectively fabricated from patterned pieces appropriately sewn together (as may be observed from FIGS. 1-18). In the preferred embodiment the foot sock is covered by the foot jacket which is sewn to the bottom portion of the upper shaft. It should be appreciated by one skilled in the art the foot jacket should be positioned below the ankle. If the jacket is secured too high on the upper shaft it eliminates the stretchability of the material that comprises the upper shaft. The foot jacket material is necessarily constructed of a non-stretch fabric material to increase the durability and wearability of the footwear product. Foot section 62 is the portion of the boot which will receive the most wear and tear and therefore is covered by a foot jacket made of a non-stretch durable fabric. The use of a non-stretch material in the construction of the foot jacket is particularly important when the jacket is pulled around the shoe last in the lasting process. Whereas the upper shaft is constructed of a stretchable material to improve the mobility, comfort and fit of the footwear product in the calf and ankle region of the user. FIG. 9 is an elevational bottom view showing the preferred way a foot jacket, sock and upper shaft is sewn together.

After sewing the upper shaft, foot jacket and sock pieces together, sealing tapes are heat sealed to all interior seems to waterproof the foot wear product. The partially completed footwear product as illustrated in FIGS. 8 and 9 is appropriately turned inside out and taped with sealing tape 46 which seals from the inside the sewn seams against water or moisture penetration. The sealing tapes are applied by hot air tape sealing techniques which completely waterproofs the partially completed footwear product 30 as depicted in the FIGS. 10-12. This creates a highly effective seal for waterproofing the sewn boot seams. The completed footwear product is then returned to customary form from its inside out form as shown in FIGS. 10-12 and checked for leaks by inserting the unit in a vat of water and if a leak is detected the seam is re-taped, if there are no leaks the upper boot is further assembled as per the next step in the manufacturing procedure.

An important feature of footwear product 30 is that it is waterproofed from the inside of the boot rather than a conventional means of waterproofing by adding vulcanized rubber on the outside of the boot. When a neoprene footwear product is covered with rubber it eliminates many of the neoprene's positive flexibility characteristics. However with the unique composite and taping techniques taught herein the seams are effectively sealed internally to provide a waterproof footwear product 30 without the use of any rubber. Conventional thermoplastic heat sealing tapes applied by conventional hot air tape sealing machines operated under heat sealing conditions (e.g. 300-380 degrees F. at 10 feet/min) may be used to apply heat and seal the seams. Thus, the manufacture of footwear product 30 may appropriately waterproof seam the laminated composite upper shaft 40, foot sock 50 and foot jacket 60 together by hot air tape sealing as opposed to conventional vulcanization techniques to produce a unique waterproof footwear product 30.

After sealing the seams of the sewn upper shaft 40, sock 50 and foot jacket 60, the completed footwear product is then returned to customary form from its inside out form as shown in FIGS. 10-12 and placed upon footwear last 61 as illustrated by FIG. 13 to finalize the manufacture of footwear product 30. FIG. 17 depicts the insertion of the toe box and heal counter between the footwear sock and the footjacket as employed in the fabrication of the footwear product. In one desired embodiment of the present invention foot section 62 includes a sized sock 50 enshrouded by foot jacket 60 which maintains reinforcement footwear components (e.g. toe box 76 a puff or stiffener, heel counter 74 and insole 72) to impart a more rigid structure to foot section 62 and provides protection that conventional neoprene rubber boots cannot provide (i.e. portion below the upper shaft 40).

As shown in FIG. 13, an unhinged shoe last is inserted into the partially shoe assembly and the extended last stretches sock 50 to conform to the shape of the last as shown in FIGS. 16 and 17. FIG. 16 is an elevational view of a partially completed footwear product with a shoe last inserted and an unattached sole being attached to sock bottom 63. FIG. 17 illustrates the placement of adhesively backed heel counter 74 and toe box 76 (for example a stiffener or puff made from formable thermoplastic, Tenco GI) positioned between the foot jacket 60 and the sock bottom along with the insole 72. Thereafter, insole 72 (illustratively a water resistant synthetic 2.25 mm Texon insole and the like) is glued to the sock bottom 63 with a shoe contact glue or adhesive applied about the outer periphery of insole 72 and jacket overhang 64 (shown in FIGS. 13 and 18) of foot jacket 60 (commonly known as skirt or blouse) is then pulled tautly with the lasting machine onto glued insole 72 and secured thereto as depicted in FIGS. 16 and 17. A conventional shoe lasting pulling machine equipped with a heel contour conforming and a toe box heating means (e.g. heated at 350 degrees F.) may be used to create the desired heel and toe configurations. The lasting machine (pulling and heating) pulls the toe section (while forming the toe puff) of foot jacket tautly about the juxtapositioned portion onto insole 72 thereto and cements jacket 60 to insole 72 as shown in FIG. 18.

Figure 18:
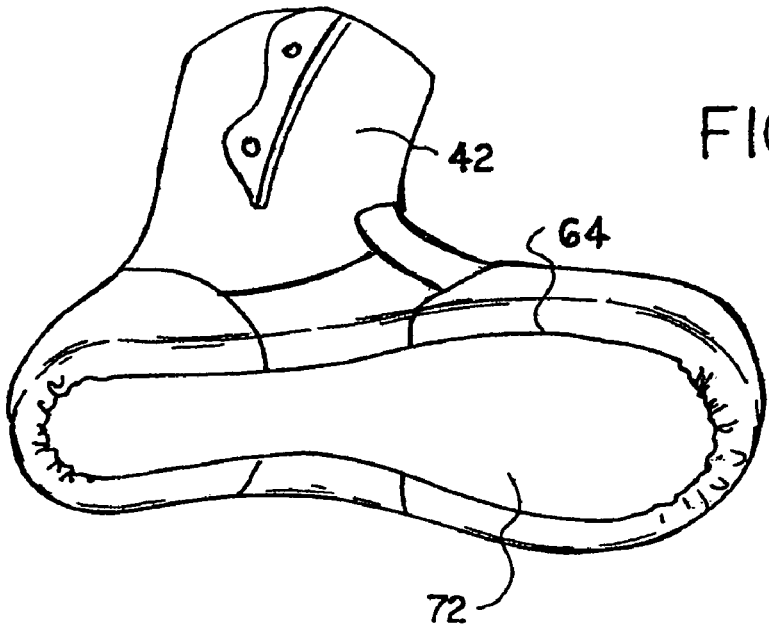
FIG. 18 is a side view of the partially assembled lasted footwear product depicting the attached insole.
Figure 19:
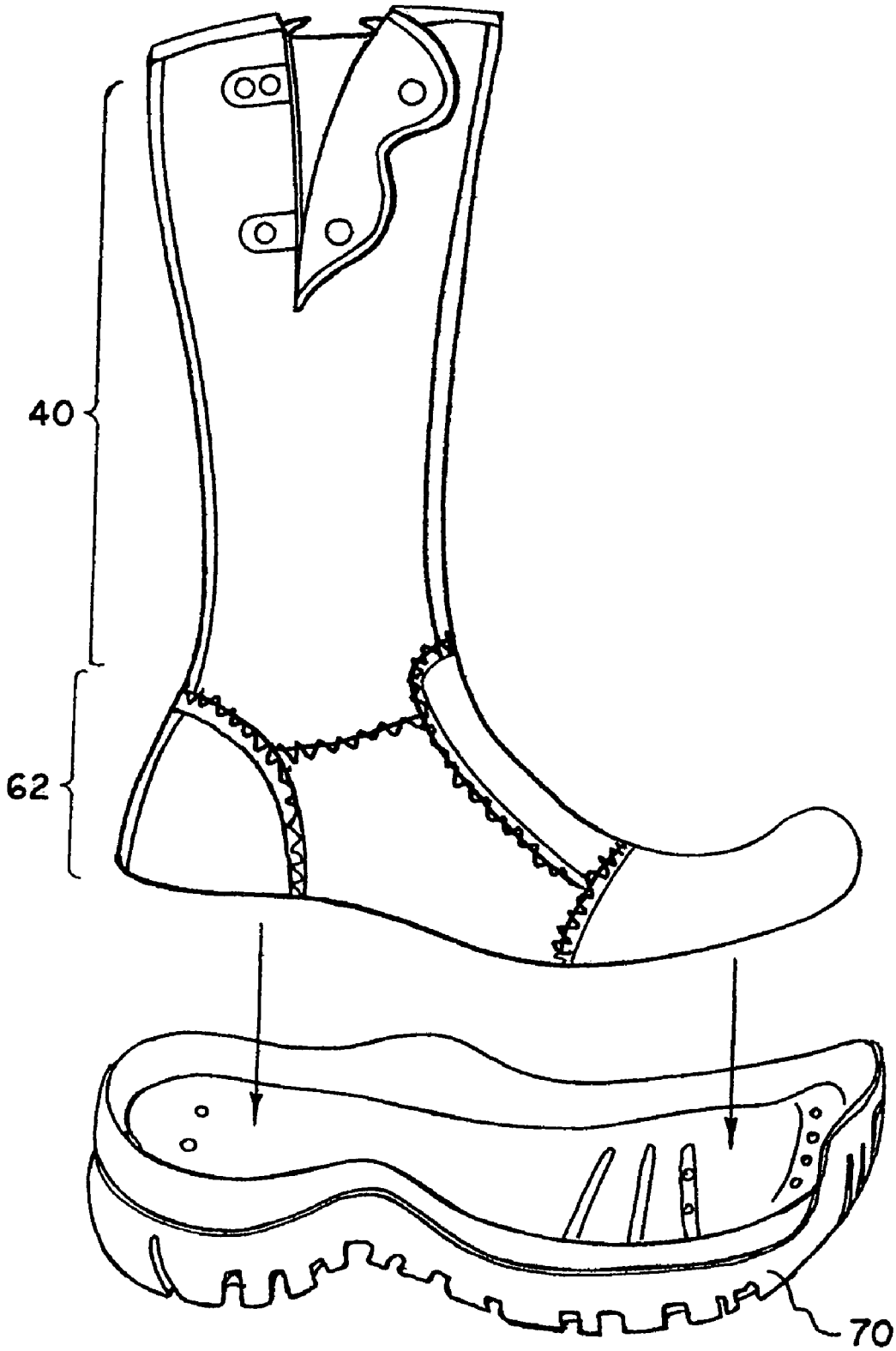
FIG. 19 is a side view of the partially assembled lasted footwear product showing how the out sole mates with the insole.

FIG. 18 depicts a partially assembled footwear product with the foot jacket 60 cemented onto insole 72 ready for the installation of out sole 70. In the lasting operation, the flat toe puff section may be heated sufficiently so that the thermoplastic material conforms to the desired last configuration. Foot jacket 60 is pulled tautly and heated so that it likewise conforms to the heal section of the last. The machine then pulls foot jacket 60 tightly about the arch section of the last so as to securely glue the arch section to insole 72. When the foot jacket 60 is pulled tightly and lasted onto the insole 72 with shoe cement, the sock 50 retains its stretched lasted form. If desired, lasting machines capable of conducting all three lasting operations may be used for this purpose. After the lasting procedure is completed the resulting product is an upper boot unit as illustrated by FIGS. 18 and 19. Alternatively, the insole 72 may be sewn to the foot jacket 60 (Strobel Slip Last) and then slip lasted over the last for assembly of the sole thereto. This insole 72 sewing technique will eliminate the need for expensive lasting equipment.

The unique construction of the preferred embodiment of the instant invention provides a foot section 62 which wears on the inside as a sock rather than a shoe, however once the structure is reinforced, as addressed above, the outside portion of foot section 62 wears like a reinforced shoe. It is common in the footwear industry to manufacture a rubber boot with a neoprene liner, however the outside rubber is unforgiving and doesn't flex with the neoprene liner in the boot and the toe and heel of the rubber boot need reinforcement. A common method of reinforcing a neoprene lined rubber boot is to merely put multiple layers of rubber over the neoprene shell, the problem with this however is that the no matter how many layers of rubber is applied it can not nearly protect the foot of the user as does footwear product 30.

The final processing step involves securing the molded rubber outsole 70 to partially completed footwear product 30. FIG. 19 illustrates a suitable outsole 70 constructed of a molded synthetic rubber configured so as to mate onto the bottom of the upper boot unit. The outsole 70 (e.g. a remolded sole) may be attached by a variety of conventional techniques such as gluing or cementing, injection molding (e.g. PU or TPR) or the outsole 70 may be integrated into the structure by cold or thermally induced vulcanization techniques. The outsole 70 may be appropriately conditioned for vulcanization by roughing or grating the surface to better prepare the surface for adhesion applying the vulcanization components and vulcanizing.

FIG. 20 is a close-up top view of one embodiment of the external surface of the footwear product of the present invention. A variety of materials or fabrics can be used for external layer 42. Any fabric as durable as possible can impregnated with a uniform sequential arrangement of small dots (circular globular polyurethane projections imparting a rough surface), upon its external surface to impart waterproofing, durability and wear ability to the footwear product 30, as shown in FIG. 20. It should be understood that the exterior surface of the boot must be as durable as rubber or better, and a polyurethane dotted coating 43 on the external surface achieves this objective.

Figure 2:
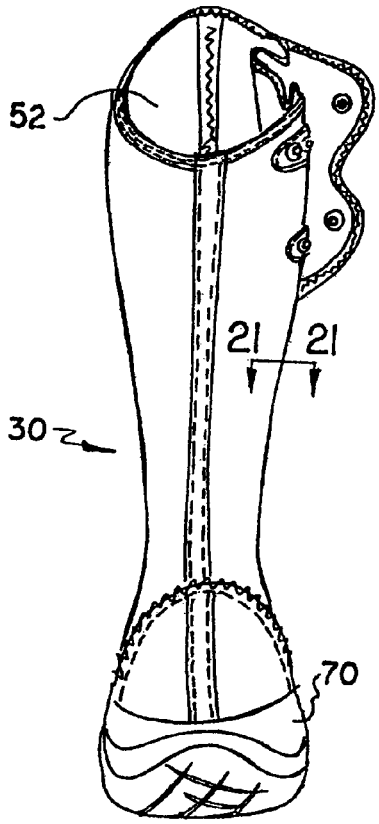
FIG. 2 is a back perspective view of a footwear product of the present invention.
Figure 3:
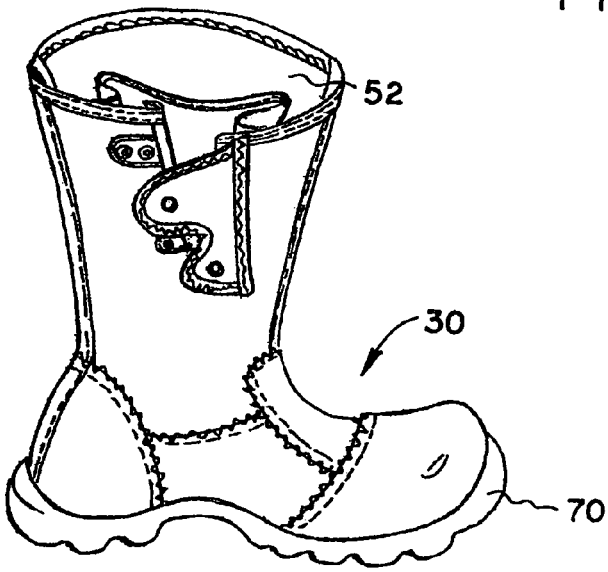
FIG. 3 a front perspective view of a footwear product device of the present invention showing interior of the product.
Figure 21:
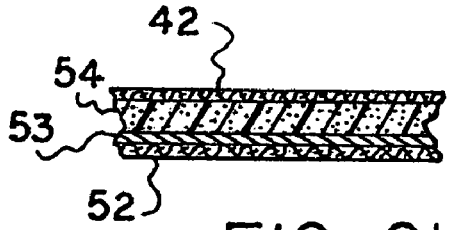
FIG. 21 is a cross sectional view taken substantially along line 21-21 of FIG. 2 showing the construction of the composite material of the present invention.

FIG. 21 is a cross sectional view taken substantially along line 21-21 of FIG. 2 showing the construction of the laminated composite material of the present invention. It should be understood, the entire inner footwear structure comprises a composite sandwich of layered material of which is generally comprised of a core of foamed elastic which most appropriately imparts the desired elasticity and insulative attributes to the footwear product for footwear upper shaft section 40 and sock 50. In a preferred embodiment of the present invention the composite structure is comprised of four layers as shown in FIG. 21, foam core 54 and PU film 53 sandwiched between external layer 42, and inner boot layer 52.

External layer 42 is comprised of the fabric material had a different characteristics for each of the components of the upper boot unit (i.e. the upper shaft, the sock and the foot jacket). External layer 42 is a durable polyester fabric coated with polyurethane dots which replaces the rubber.

Foam core 54 is a neoprene core providing great insulation. Foam core 54 is a neoprene core, such as an expanded closed cell of a 100% CR-Chloroprene rubber (neoprene) utilizing a 99.7% calcium carbonate as blowing agent precursor to create more than 93% micro closed cell structure. PU film 53 is a metallic alloy such as titanium alpha coating barrier applied to the foam core 54 surface to increase the installation through heat reflection. In addition, PU film 53 is the basis for waterproofing capability of a composite of the foot wear product. PU film 53 is sandwiched between the neoprene foam core 54 and the laminated fabric layer 52.

The inner boot layer 52 is a Tricot fabric which is a tapable semi-stretchable 100% nylon wrap knit furnished by Yamamoto Corporation, the melting characteristic of inner boot layer 52 allows the heat sealing glue from the internal tape to pass through to the PU film 53 and heat seal the composite structure avoiding capillary and making the unit waterproof. This tricot fabric is developed for breathable fabrics which are always non-stretchable. Never before in the art has there been developed a combination of composite materials which comprise this type of tricot laminated over neoprene, because the main purpose of using neoprene is to take advantage of its stretchable characteristics and until now it has been thought that if it is used in conjunction with less stretchable tricot it diminishes this characteristic. The limited stretchability prohibits the making of many neoprene products. However the stretchability of the neoprene in conjunction with the other layers of this composite, especially the tricot layer, allow the tricot to be stretchable enough to make a formfitting waterproofed footwear product of the instant invention. The advantage obtained is to have a composite material having enough stretch to have ability to make a non-glued neoprene seem waterproofed (i.e sewn seam).

While preferred embodiments of the present invention have been disclosed, it is to be understood that the present invention is not limited thereto, but may be otherwise embodied within the scope of the following claims.

What is claimed is:

1. A rubberless form fitting neoprene boot waterproofed from the inside comprised of:

a seamed composite sock fabricated from a neoprene foam that provides insulation, a tapable polyurethane film with titanium coating to provide heat reflection and allow waterproofing of said seams sandwiched by a tapable tricot liner to avoid capillary movement of water and stretchable external layer that may be stretched and formed upon a shoe last;

a composite upper shaft section extending from said sock; wherein said upper shaft is a composite of said neoprene foam, said polyurethane film sandwiched by said tapable tricot liner and a semistretchable external layer that is a durable fabric;

an external foot jacket attached to said upper shaft jacketing said sock forming an upper boot unit having internal seams;

a series of thermoplastic heat sealing tapes to collectively seal all said internal seams against the penetration of moisture;

a toe reinforcing stiffener and a heel reinforcing stiffener located between said stretchable external layer of said sock and said foot jacket;

an inner sole secured to said sock by a border of said external foot jacket;

an outer sole securely anchored to a bottom end of said inner sole.

2. A footwear construction comprising:

a composite sock to define a cavity for receiving a foot;

a composite upper shaft section extending from said sock wherein said sock and said upper shaft is fabricated from a composite of a foam core coated on at least one side with a heat reflecting polyurethane film coating sandwiched by an internal fabric liner and an external layer of fabric;

an external foot jacket attached to said upper shaft jacketing said sock forming an upper boot unit having internal seams and an external surface;

a sealing means to collectively seal all said internal seams against the penetration of moisture;

an inner sole secured to said sock by a border of said external foot jacket;

an outer sole securely anchored to a bottom end of said inner sole.

3. A footwear construction as set forth in claim 2 wherein said external surface of said upper boot unit includes circular globular polyurethane projections imparting a rough surface.

4. A footwear construction as set forth in claim 3 including a toe reinforcing stiffener and a heel reinforcing stiffener located between said external stretchable fabric layer of said sock and said foot jacket.

5. A footwear construction as set forth in claim 3 wherein said foam core is a neoprene core; said polyurethane film coating is metal alloy coating such as a titanium alloy; and said internal fabric liner is a tapable tricot liner to avoid capillary of water.

6. A footwear construction as set forth in claim 2 wherein said external layer of said upper shaft is a semi-stretchable fabric and wherein said external layer of fabric of said sock is a stretchable fabric.

7. A footwear construction as set forth in claim 6 wherein said sealing means comprise thermoplastic heat sealing tapes.

* * * * *